US006773379B1

(12) United States Patent
Bing

(10) Patent No.: US 6,773,379 B1
(45) Date of Patent: Aug. 10, 2004

(54) EXERCISE DEVICE FOR THE UPPER TORSO OF A USER

(76) Inventor: James Bing, 81 Albion Pl., Staten Island, NY (US) 10302

( * ) Notice: Subject to any disclaimer, the term of this patent is extended or adjusted under 35 U.S.C. 154(b) by 211 days.

(21) Appl. No.: 09/897,504

(22) Filed: Jul. 2, 2001

(51) Int. Cl.[7] ..... A63B 23/04
(52) U.S. Cl. ..... 482/132; 482/907
(58) Field of Search ..... 482/132, 141, 482/907, 146, 147, 95, 96, 127, 904, 93, 8

(56) References Cited

U.S. PATENT DOCUMENTS 2,069,384 A * 2/1937 Ogden ..... 482/132
3,616,794 A * 11/1971 Gromala
3,809,393 A 5/1974 Jones ..... 272/575
4,134,584 A * 1/1979 Rosenbusch ..... 482/132
4,892,305 A * 1/1990 Lynch ..... 482/132
5,261,866 A 11/1993 Mattox ..... 482/125
5,632,707 A * 5/1997 Daniel et al. ..... 482/8
5,921,901 A 7/1999 Palacios ..... 482/132
D428,454 S 7/2000 Fischer et al. ..... D21/662

* cited by examiner

*Primary Examiner*—Jerome W. Donnelly
(74) *Attorney, Agent, or Firm*—Richard L. Miller

(57) ABSTRACT

An exercise device for the upper torso of a user that includes a base, a plurality of wheel assemblies, and a handle assembly. The base is equilateral triangular-shaped and has an uppermost surface and a lowermost surface. The handle assembly is swivelly positioned in the uppermost surface of the base so as to allow the handle assembly to achieve a desired hand position relative to the plurality of wheel assemblies. The plurality of wheel assemblies are three and in combination with the base being equilateral triangular-shaped, prevent rocking. Each wheel assembly is rotatably mounted in the lowermost surface of the base.

13 Claims, 1 Drawing Sheet

EXERCISE DEVICE FOR THE UPPER TORSO OF A USER

BACKGROUND OF THE INVENTION

1. Field of the Invention

The present invention relates to an exercise device. More particularly, the present invention relates to an exercise device for the upper torso of a user.

2. Description of the Prior Art

Numerous innovations for exercise devices have been provided in the prior art that will be described. Even though these innovations may be suitable for the specific individual purposes to which they address, however, they differ from the present invention.

A FIRST EXAMPLE, U.S. Pat. No. Des. 428,454 to Fischer et al. teaches the ornamental design for an exercise device.

A SECOND EXAMPLE, U.S. Pat. No. 5,261,866 to Mattox teaches an improved wheeled exercise device which is adjustable for users of different size and muscle capability. The device comprises a wheel rotatable mounted on an axle, a pair of handgrips telescopically mounted on the axle, and a length of elastic tubing telescopically mounted on the opposite ends of the axle. A pair of pads are adjustably mounted on the elastic tubing. The pads may be moved to different points along the length of the tubing to accommodate users of different size and strength. The user kneels or stands on the pads, grips the handgrips, and rolls the wheel and axle forward, away from the pads until the user is in the prone position. Thereafter, the user rolls the axle and wheel backward, until the starting position is reached.

A THIRD EXAMPLE, U.S. Pat. No. 5,632,707 to Daniel et al. teaches a device for exercising a user's upper torso that utilizes a minimum of space. A wheeled housing is provided with a handle member providing an effective grip to a user who will lean his or her body's weight against the device is coupled to one or more of the wheels to display the amount of rotation of the wheels thereby giving an indication to a user of the amount of exercise undertaken. A reader of the movement of the device has an output connected to a counter/display that is resettable. The reader is mounted in a spring loaded cavity so that an effective outwardly force brings its ball member in contact with the surface.

A FIFTH EXAMPLE, U.S. Pat. No. 5,921,901 to Palacios teaches an exercise apparatus of a push-pull type for exercising a person's abdominal muscles that includes a track unit formed by a track board having an upper, body supporting surface extending between front and rear ends; an elongate, track-supporting base board for extending horizontally across a floor; a knee support on the base board adjacent the rear end of the track board; and, a support member for supporting the track board pivotally connected to overlie the base board with the rear end adjacent the base board and the front end at selected elevations. A hand-grip carriage unit with a pair of hand grips and an elbow support aligned rearward of the hand-grips is removably mounted by rollers on the body supporting surface for reciprocal rolling movement therealong. An anchoring unit for a person's legs or hands, alternatively, can be releasably mounted to the front end of the track board, when elevated.

It is apparent that numerous innovations for exercise devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide an exercise device for the upper torso of a user that avoids the disadvantages of the prior art.

ANOTHER OBJECT of the present invention is to provide an exercise device for the upper torso of a user that is simple and inexpensive to manufacture.

STILL ANOTHER OBJECT of the present invention is to provide an exercise device for the upper torso of a user that is simple to use.

BRIEFLY STATED, STILL YET ANOTHER OBJECT of the present invention is to provide an exercise device for the upper torso of a user that includes a base, a plurality of wheel assemblies, and a handle assembly. The base is equilateral triangular-shaped and has an uppermost surface and a lowermost surface. The handle assembly is swivelly positioned in the uppermost surface of the base so as to allow the handle assembly to achieve a desired hand position relative to the plurality of wheel assemblies. The plurality of wheel assemblies are three and in combination with the base being equilateral triangular-shaped, prevent rocking. Each wheel assembly is rotatably mounted in the lowermost surface of the base.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

DESCRIPTION OF THE DRAWING

The figures of the drawing are briefly described as follows.

LIST OF REFERENCE NUMERALS UTILIZED IN THE DRAWING

Figure 1:
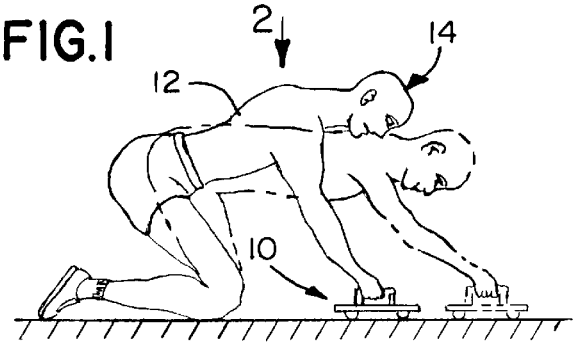
FIG. 1 is a diagrammatic side elevational view of the present invention in use.

10 exercise device of present invention for upper torso 12 of user 14
12 upper torso of user 14
14 user
16 base
18 plurality of wheel assemblies
20 handle assembly
22 uppermost surface of base 16
24 lowermost surface of base 16
25 three corners of base 16

26 throughbore extending centrally through base 16
28 blindbore in uppermost surface 22 of base 16
30 three blindbores in lowermost surface 24 of base 16
31 notches in lowermost surface 24 of base 16
32 resilient donut of handle assembly 20
34 disk of handle assembly 20
36 uppermost surface of disk 34 of handle assembly 20
38 lowermost surface of disk 34 of handle assembly 20
40 handle of handle assembly 20
42 screws of handle assembly 20
44 threaded rod of handle assembly 20
46 back plate of handle assembly 20
48 uppermost surface of back plate 46 of handle assembly 20
50 lowermost surface of back plate 46 of handle assembly 20
52 throughbore extending centrally through back plate 46 of handle assembly 20
54 blindbore in uppermost surface 48 of back plate 46 of handle assembly 20
56 washer of handle assembly 20
58 wing nut of handle assembly 20
60 wheel of each wheel assembly of plurality of wheel assemblies 18
62 throughbore extending centrally and horizontally through wheel 60 of each wheel assembly of plurality of wheel assemblies 18
64 axle of each wheel assembly of plurality of wheel assemblies 18
66 pair of retaining straps of each wheel assembly of plurality of wheel assemblies 18
68 screws of each wheel assembly of plurality of wheel assemblies 18

DETAILED DESCRIPTION OF THE PREFERRED EMBODIMENT

Figure 2:
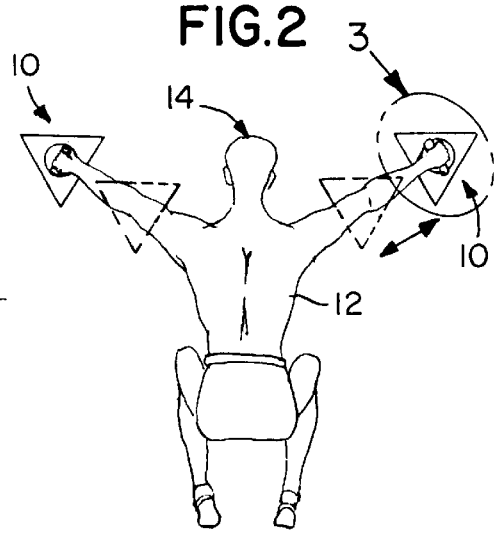
FIG. 2 is a diagrammatic top plan view taken generally in the direction of arrow 2 in FIG. 1.

Referring now to the figures, in which like numerals indicate like parts, and particularly to FIGS. 1 and 2, the exercise device of the present invention is shown generally at 10 for the upper torso 12 of a user 14.

Figure 3:
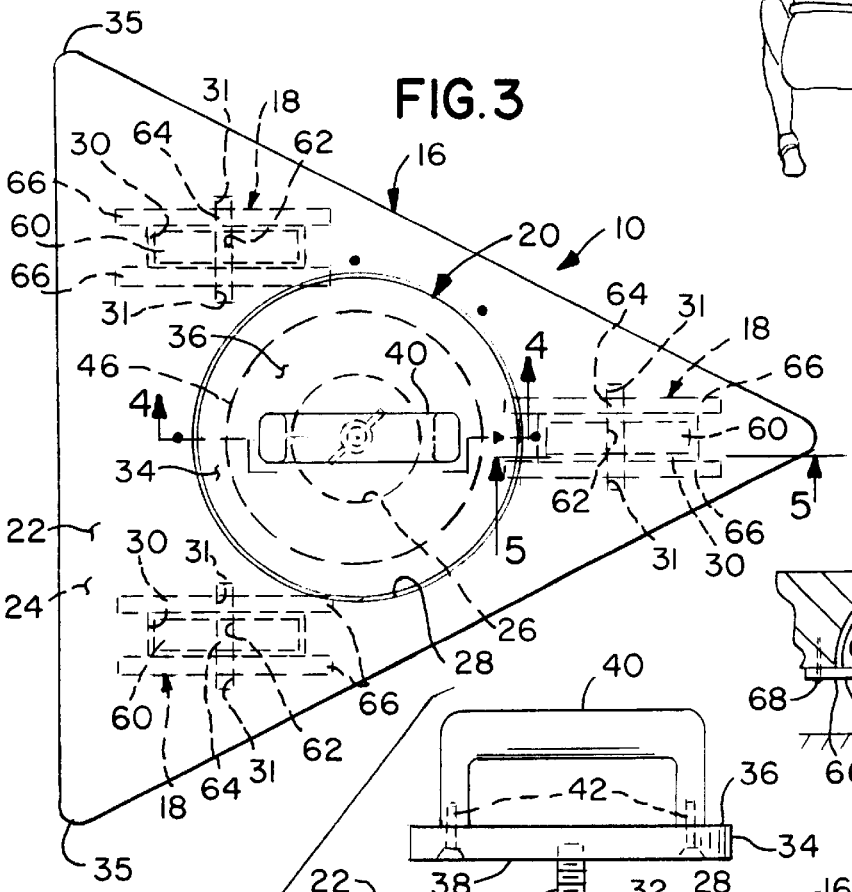
FIG. 3 is an enlarged diagrammatic top plan view of the area generally enclosed by the dotted curve identified by arrow 3 in FIG. 2 of the present invention.

The overall configuration of the exercise device 10 can best be seen in FIG. 3, and as such, will be discussed with reference thereto.

The exercise device 10 comprises a base 16, a plurality of wheel assemblies 18 that rotatably depend from the base 16, and a handle assembly 20 that extends upwardly from the base 16.

Figure 5:
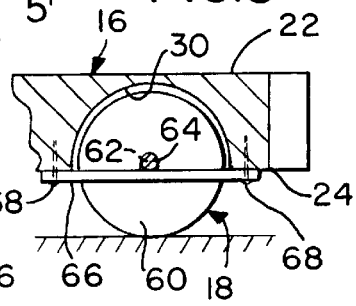
FIG. 5 is a diagrammatic cross sectional view taken on line 5—5 in FIG. 3 of a typical wheel assembly of the present invention.
Figure 4:
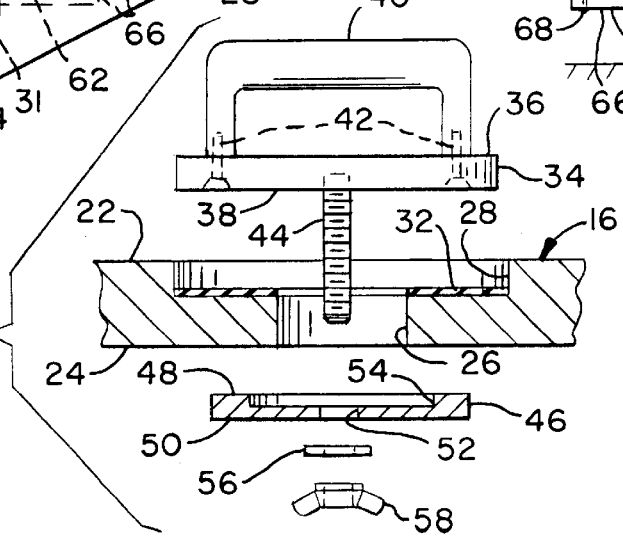
FIG. 4 is an exploded diagrammatic cross sectional view taken on line 4—4 in FIG. 3 of the handle assembly of the present, invention.

The specific configuration of the base 16 can best be seen in FIGS. 3–5, and as such, will be discussed with reference thereto.

The base 16 is flat, equilateral triangular-shaped, and has an uppermost surface 22, a lowermost surface 24, and three corners 25.

The base 16 further has a throughbore 26 that extends centrally therethrough, from the uppermost surface 22 thereof to the lowermost surface 24 thereof.

The throughbore 26 in the base 16 is cylindrically-shaped, and has an axis that is vertically-oriented.

The uppermost surface 22 of the base 16 has a blindbore 28 that depends therein, and is wider than, communicates with, and is concentric with, the throughbore 26 through the base 16.

The blindbore 28 in the uppermost surface 22 of the base 16 is disk-shaped, and has an axis that is vertically-oriented.

The lowermost surface 24 of the base 16 has three blindbores 30 that extend therein, and are parallel to each other.

Each blindbore 30 in the lowermost surface 24 of the base 16 is disposed in proximity to a respective corner 35 of the base 16, is semi-disk-shaped, and has an axis that is horizontally-oriented.

The lowermost surface 24 of the base 16 further has notches 31 that are cylindrically-shaped, and extend along the axis of, to each side of, and communicate with, each blindbore 30 in the lowermost surface 24 of the base 16.

The specific configuration of the handle assembly 20 can best be seen in FIGS. 3 and 4, and as such, will be discussed with reference thereto.

The handle assembly 20 comprises a resilient donut 32 that is seated in the blindbore 28 in the uppermost surface 22 of the base 16.

The handle assembly 20 further comprises a disk 34 that is swivelly positioned in, and substantially conforms to, the blindbore 28 in the uppermost surface 22 of the base 16 so as to allow the handle assembly 20 to achieve a desired hand position relative to the plurality of wheel assemblies 18.

The disk 34 of the handle assembly 20 overlies the resilient donut 32, and has an uppermost surface 36 and a lowermost surface 38.

The handle assembly 20 further comprises a handle 40 that is inverted U-shaped, and is affixed centrally on the uppermost surface 36 of the disk 34, by screws 42.

The handle assembly 20 further comprises a threaded rod 44 that depends centrally from, by being partially threaded into, the lowermost surface 38 of the disk 34, and extends through the throughbore 26 in, and past the lowermost surface 24 of, the base 16.

The handle assembly 20 further comprises a back plate 46 that is disk-shaped, and has an uppermost surface 48, a lowermost surface 50, and a throughbore 52 that extends centrally therethrough, from the uppermost surface 48 thereof to the lowermost surface 50 thereof.

The uppermost surface 48 of the back plate 46 has a blindbore 54 that depends therein, and is wider than, communicates with, and is concentric with, the throughbore 53 through the back plate 46.

The uppermost surface 48 of the back plate 46 abuts against the lowermost surface 24 of the base 16, the blindbore 54 therein is wider than, and concentric with, the throughbore 26 through the base 16, and the threaded rod 44 extends through the throughbore 52 in the back plate 46, receives a washer 56, and threadably engages a wing nut 58 which when tightened causes the blindbore 54 in the back plate 46 and the resilient donut 32 to compress and maintain the handle 40 in a desired swiveled position.

The specific configuration of each wheel assembly 18 can best be seen in FIGS. 3 and 4, and as such, will be discussed with reference thereto.

The plurality of wheel assemblies 18 was chosen to be three and in combination with the base 16 being chosen to be equilateral triangular-shaped, prevent rocking.

Each wheel assembly 18 comprises a wheel 60 that is rotatably mounted in a respective blindbore 30 in the lowermost surface 24 of the base 16, and has a throughbore 62 that extends centrally and horizontally therethrough.

Each wheel assembly 18 further comprises an axle 64 that extends fixedly in, and equidistantly past both sides of, the wheel 60 to a pair of free ends which are rotatably received in the notches 31 in the lowermost surface 24 of the base 16 of an associated blindbore 30 in the lowermost surface 24 of the base 16.

Each wheel assembly 18 further comprises a pair of retaining straps 66 that straddle the wheel 60, are attached to the lowermost surface 24 of the base 16 by screws 68, and extend orthogonally across, and maintain in the notches 32 in the lowermost surface 24 of the base 16, the axle 64.

It will be understood that each of the elements described above, or two or more together, may also find a useful application in other types of constructions differing from the types described above.

While the invention has been illustrated and described as embodied in an exercise device for the upper torso of a user, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An exercise device for the upper torso of a user, comprising:

a) a base;

b) a plurality of wheel assemblies; and c) a handle assembly;

wherein said plurality of wheel assemblies rotatably depend from said base; and wherein handle assembly extends upwardly from said base, wherein said base is flat;

wherein said base is equilateral triangular-shaped;

wherein said base has an uppermost surface;

wherein said base has a lowermost surface; and wherein said base has three corners, wherein said base has a throughbore;

wherein said throughbore extends centrally through said base; and wherein said throughbore extends from said uppermost surface of said base to said lowermost surface of said base, wherein said uppermost surface of said base has a blindbore that depends therein;

wherein said blindbore in said uppermost surface of said base is wider than said throughbore through said base;

wherein said blindbore in said uppermost surface of said base communicates with said throughbore through said base; and wherein said blindbore in said uppermost surface of said base is concentric with said throughbore through said base, wherein said handle assembly comprises a resilient donut; and wherein said resilient donut is seated in said blindbore in said uppermost surface of said base.

2. The device as defined in claim 1, wherein said throughbore in said base is cylindrically-shaped;

wherein said throughbore in said base has an axis; and wherein said axis of said throughbore in said base is vertically-oriented.

3. The device as defined in claim 1, wherein said blindbore in said uppermost surface of said base is disk-shaped;

wherein said blindbore in said uppermost surface of said base has an axis; and wherein said axis of said blindbore in said uppermost surface of said base is vertically-oriented.

4. The device as defined in claim 1, wherein said handle assembly comprises a disk;

wherein said disk substantially conforms to said blindbore in said uppermost surface of said base; and wherein said disk is swivelly positioned in said blindbore in said uppermost surface of said base so as to allow said handle assembly to achieve a desired hand position relative to said plurality of wheel assemblies.

5. The device as defined in claim 4, wherein said disk of each handle assembly overlies said resilient donut;

wherein said disk of each handle assembly has an uppermost surface; and wherein said disk of each handle assembly has a lowermost surface.

6. The device as defined in claim 5, wherein said handle assembly comprises a handle;

wherein said handle is inverted U-shaped;

wherein said handle is affixed centrally on said uppermost surface of said disk; and wherein said handle is affixed on said uppermost surface of said disk by screws.

7. The device as defined in claim 5, wherein said handle assembly comprises a threaded rod;

wherein said threaded rod depends centrally from said lowermost surface of said disk;

wherein said threaded rod is partially threaded into said lowermost surface of said disk so as to be affixed thereto;

wherein said threaded rod extends through said throughbore in said base; and wherein said threaded rod extends past said lowermost surface of said base.

8. The device as defined in claim 7, wherein said handle assembly comprises a back plate;

wherein said back plate is disk-shaped;

wherein said back plate has an uppermost surface;

wherein said back plate has a lowermost surface;

wherein said back plate has a throughbore;

wherein said throughbore extends centrally through said back plate; and wherein said throughbore extends from said uppermost surface of said back plate to said lowermost surface of said back plate.

9. The device as defined in claim 8, wherein said uppermost surface of said back plate has a blindbore that depends therein;

wherein said blindbore in said uppermost surface of said back plate is wider than said throughbore through said back plate;

wherein said blindbore in said uppermost surface of said back plate communicates with said throughbore through said back plate; and wherein said blindbore in said uppermost surface of said back plate is concentric with said throughbore through said back plate.

10. The device as defined in claim 9, wherein said uppermost surface of said back plate abuts against said lowermost surface of said base;

wherein said blindbore in said back plate is wider than said throughbore through said base;

wherein said blindbore in said back plate is concentric with said throughbore through said base; and wherein said threaded rod extends through said throughbore in said back plate, receives a washer, and threadably engages a wing nut which when tightened causes said blindbore in said back plate and said resilient donut to compress and maintain said handle in a desired swiveled position.

11. The device as defined in claim 1, wherein said plurality of wheel assemblies is three and in combination with said base being equilateral triangular-shaped, prevent rocking.

12. An exercise device for the upper torso of a user, comprising:

a) a base;

b) a plurality of wheel assemblies; and c) a handle assembly;

wherein said plurality of wheel assemblies rotatably depend from said base; and wherein handle assembly extends upwardly from said base, wherein said base is flat;

wherein said base is equilateral triangular-shaped;

wherein said base has an uppermost surface;

wherein said base has a lowermost surface; and wherein said base has three corners, wherein said lowermost surface of said base has three blindbores; and wherein said three blindbores in said lowermost surface of said base are parallel to each other, wherein each blindbore in said lowermost surface of said base is disposed in proximity to a respective corner of said base;

wherein each blindbore in said lowermost surface of said base is semi-disk-shaped;

wherein each blindbore in said lowermost surface of said base has an axis; and wherein said axis of each blindbore in said lowermost surface of said base is horizontally-oriented, wherein said lowermost surface of said base has notches;

wherein said notches in said lowermost surface of said base are cylindrically-shaped;

wherein said notches in said lowermost surface of said base extend along said axis of each blindbore in said lowermost surface of said base;

wherein said notches in said lowermost surface of said base extend to each side of each blindbore in said lowermost surface of said base; and wherein said notches in said lowermost surface of said base communicate with an associated blindbore in said lowermost surface of said base, wherein each wheel assembly comprises a wheel;

wherein said wheel is rotatable mounted in a respective blindbore in said lowermost surface of said base;

wherein said wheel has a throughbore;

wherein said throughbore extends centrally through said wheel; and wherein said throughbore extends horizontally through said wheel, wherein each wheel assembly comprises an axle;

wherein said axle extends fixedly in said throughbore through said wheel to affair of free ends;

wherein said pair of free ends of said axle are rotatable received in said notches in said lowermost surface of said base of an associated blindbore in said lowermost surface of said base; and wherein said axle extends equidistantly past both sides of said wheel, wherein each wheel assembly comprises a pair of retaining straps;

wherein said pair of retaining straps straddle said wheel;

wherein said pair of retaining straps are attached to said lowermost surface of said base;

wherein said pair of retaining straps are attached to said lowermost surface of said base by screws;

wherein said pair of retaining straps extend orthogonally across said axle; and wherein said pair of retaining straps rotatably maintain said axle in said notches in said lowermost surface of said base.

13. The device as defined in claim 12, wherein said plurality of wheel assemblies is three and in combination with said base being equilateral triangular-shaped, prevent rocking.

* * * * *